United States Patent [19]

Gray

[11] Patent Number: 4,726,700

[45] Date of Patent: Feb. 23, 1988

[54] RUB-ON APPLICATOR

[76] Inventor: James R. Gray, 8816 Westwood, Little Rock, Ark. 72204

[21] Appl. No.: 860,484

[22] Filed: May 7, 1986

[51] Int. Cl.[4] ..... B05C 17/00; B43M 11/06

[52] U.S. Cl. ..... 401/183; 222/109; 222/215; 401/15; 401/196

[58] Field of Search ..... 401/196, 202, 205–207, 401/15, 183–186; 222/109, 212, 215, 206, 571

[56] References Cited

U.S. PATENT DOCUMENTS

| | | | |
|---|---|---|---|
| 591,434 | 10/1897 | Tallmadge | 401/196 |
| 2,095,423 | 10/1937 | Tilley | 401/207 |
| 2,661,743 | 12/1953 | Archer | 222/215 X |
| 2,758,755 | 8/1956 | Schafler | 222/212 |
| 2,825,603 | 3/1958 | Altergott | 222/215 X |
| 2,853,727 | 9/1958 | Nadai | 401/202 |
| 3,010,138 | 11/1961 | Nadai | 401/15 X |
| 3,081,769 | 3/1963 | Ackerman | 401/196 |
| 3,093,273 | 6/1963 | Borah . | |
| 3,189,282 | 6/1965 | Corsette | 222/206 |
| 3,337,124 | 8/1967 | De Molin et al. | 401/185 X |
| 3,337,900 | 8/1967 | Schwartzman | 222/212 X |
| 4,073,413 | 2/1978 | Tabler et al. . | |
| 4,230,240 | 10/1980 | Laauwe | 401/186 |

FOREIGN PATENT DOCUMENTS

| | | | |
|---|---|---|---|
| 769416 | 3/1957 | United Kingdom | 401/202 |

*Primary Examiner*—David H. Corbin

*Attorney, Agent, or Firm*—Spencer & Frank

[57] ABSTRACT

A rub-on applicator for rubbing liquid onto a surface to be coated. The applicator includes a flexible compressible bottle containing the liquid to be dispensed. The mouth of the bottle is covered by a thin flexible molded diaphragm sealed to the lip of the bottle. The diaphragm is formed with a small, centrally located, permanently open hole. In one embodiment, the diaphragm normally projects concavely under suction forces into the bottle, but is sufficiently flexible that by squeezing and compressing the bottle, the diaphragm will be forced by compression of fluid in the bottle to project convexly outward of the bottle with a broadly rounded outer surface, so that by turning the bottle upside down and squeezing the bottle, liquid within the bottle is forced therefrom onto to a surface to be coated. Since the hole in the diaphragm is permanently open, when the applicator is upright with the diaphragm in its normally inwardly projecting position, any liquid on the outer surface of the diapraghm will flow through the hole into the bottle.

20 Claims, 9 Drawing Figures

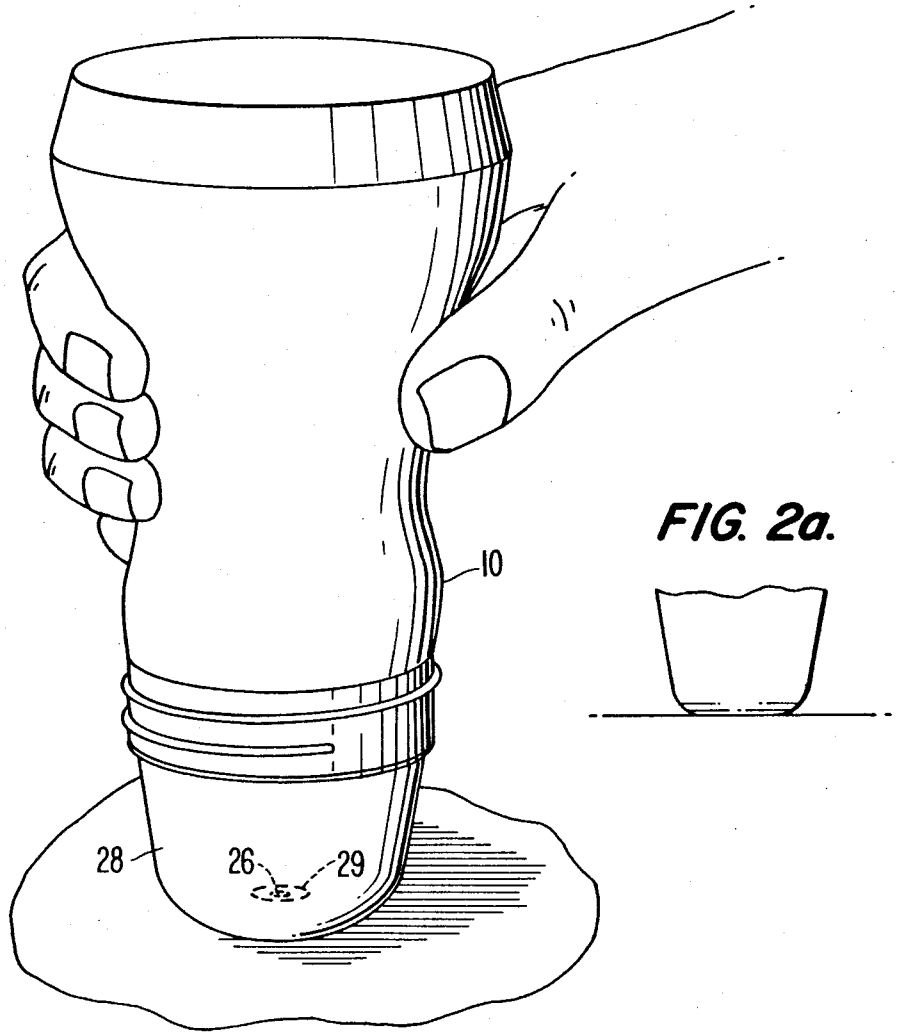
FIG. 2.
FIG. 2a.
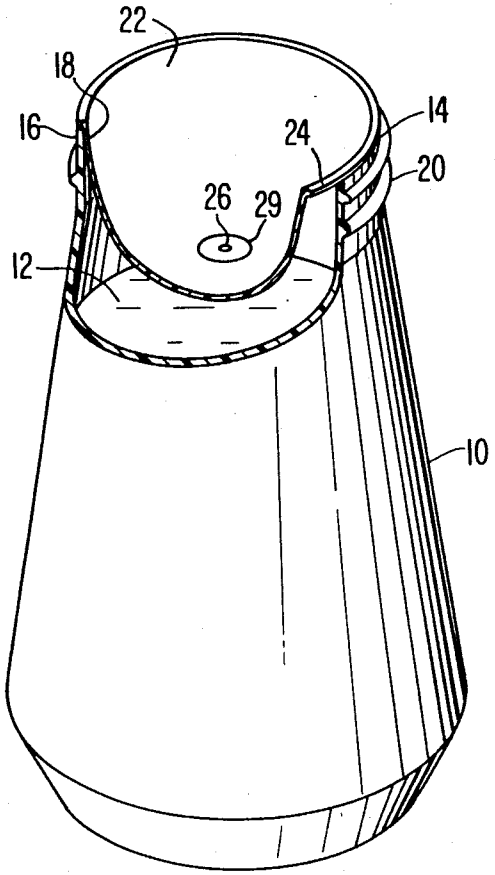
FIG. 1.

RUB-ON APPLICATOR

BACKGROUND OF THE INVENTION

This invention relates to a device for the thin film application of liquid products, and more particularly a self-contained unit including a reservoir for the liquid product, and an integral applicator for applying and spreading the liquid on a desired surface.

The current devices for the application of liquid films to various surfaces can be broadly divided into two categories: spray generating containers and rub-on systems.

The spray category comprises liquid containers which atomize and spray the liquid product through aerosol, mechanical pump, or squeeze bottle action. Devices in this category are convenient, but severely limited in their ability to atomize and spray viscous liquid in fine, controlled coatings. In addition, the manufacturing cost of these devices results in products of relatively high retail price.

The rub-on category comprises numerous brush, pad, and ball roll-on systems. Devices in this category can be successfully used for the application of viscous liquids, but are not as convenient as sprays, and incur additional drawbacks when applied to several specific product uses.

Rub-on devices which include brushes are typically removably mounted to a container containing a reservoir of liquid. In use, the brushes must be removed from the container, used, returned to the container to be replenished with liquid from the reservoir as often as needed, then sealed back in the container after use. In uses where the applied liquid is sensitive to bacterial degradation (food, cosmetic, medical, etc.), repeatedly returning the brush to a liquid reservoir after contacting outside surfaces creates a health hazard.

Porous or fibrous pads attached to the top of a container defining the liquid reservoir (to spread liquid squeezed through the pad) generally suffer from the same bacterial restraints as brushes. In addition, the thin film of liquid maintained on the surface of such pads during storage is subject to oxidation and hardening if sensitive liquids such as food, oils or cosmetics are used. Also, although it may be desired to wipe the pad clean from time to time, the rough surface of pad is virtually impossible to wipe clean.

With ball or roller roll-on applicators, bacterial contamination of their reservoir can generally be avoided, and such applicators are convenient to use. However, they are relatively expensive, and the rigid ball or roller of such devices will not apply liquid to irregular, hard or very soft surfaces. This precludes their use in applications such as coating cooking utensils with oil, applying condiments to bread, applying medication to a wound, etc.

An object of the present invention is to provide an improved liquid application device which is self-contained and offers quick, easy operation. Another object of the present invention is to provide an improved liquid applicator which can apply thin or viscous liquids in uniform coatings of selected thickness to smooth or irregular surfaces. Still another object of the present invention is to provide an improved liquid applicator which is easy to clean, and protects a reservoir liquid from bacterial attack and oxidation. A further object of the present invention is to provide an improved liquid applicator which is suitable for inexpensive high-speed manufacture.

SUMMARY OF THE INVENTION

In accordance with the invention, a rub-on applicator for rubbing liquid onto a surface to be coated is provided which includes a flexible compressible container such as a bottle, containing the liquid to be dispensed and rubbed on the surface. The mouth of the bottle is covered by a thin flexible molded diaphram formed of such materials as nylon and/or silicone, sealed to the lip of the bottle. The diaphram is formed with a small, centrally located, permanently open hole.

In one embodiment of the applicator, the diaphram normally projects concavely under suction forces into the bottle. Since the hole in the diaphram is permanently open, when the applicator is upright with the diaphram in its normally inwardly projecting position, any liquid on the outer surface of the diaphram will flow through the hole into the bottle. The diaphram is sufficiently flexible that by squeezing and compressing the bottle, the diaphram will be forced by compression of fluid in the bottle to project convexly outwardly of the bottle with a broadly rounded outer surface.

In use, by turning the bottle upside down and squeezing the bottle, liquid within the bottle is forced from the bottle onto the surface to be coated. The outer surface of the diaphram is sufficiently broadly rounded so that the liquid squeezed from the bottle may be easily rubbed with the diaphram in direct contact therewith over the surface to be coated. When the compression of the bottle is released and the applicator is turned upright, the diaphram is drawn back inwardly of the bottle by suction as the central hole in the diaphram is sufficiently small that air is prevented from flowing through the hole sufficiently rapidly to fill the additional volume in the bottle.

For certain applications it is contemplated that a layer of foam material is provided on the outer surface of the diaphram to provide a rough irregular spreading surface. For other applications, a porous fibrous or foam layer is provided on a central portion of the inner surface of the diaphram to regulate the outward flow of liquid through the hole.

In accordance with another embodiment of the invention, the centrally located hole in the diaphram is sufficiently large that when the applicator is turned upright after use and compression on the bottle is released, sufficient air will flow into the bottle through the hole so that the diaphram will not be drawn inward by suction. Thus, the diaphram always projects convexly outwardly of the bottle. In order to assure that any liquid remaining on the surface of the diaphram drips back into the bottle with the applicator has been turned upright, a narrow portion of the diaphram adjacent the edge of the mouth of the bottle is formed in an outwardly opening channel for collecting the remaining liquid, and the channel is provided with small holes through which the collected liquid will flow into the bottle.

BRIEF DESCRIPTION OF THE DRAWINGS

These and other features and advantages of the invention will be better understood from the following detailed description of the preferred embodiments with reference to the accompanying drawings in which:

FIG. 1 is a perspective view of a first embodiment of the rub-on applicator of the present invention in an upright rest position with parts broken away for clarity;

FIG. 2 is a perspective view of the rub-on applicator of FIG. 1 in use;

FIG. 2*a* is a partial elevational view of the diaphram of the rub-on applicator in use;

DETAILED DESCRIPTION OF THE PREFERRED EMBODIMENTS

Figure 3:
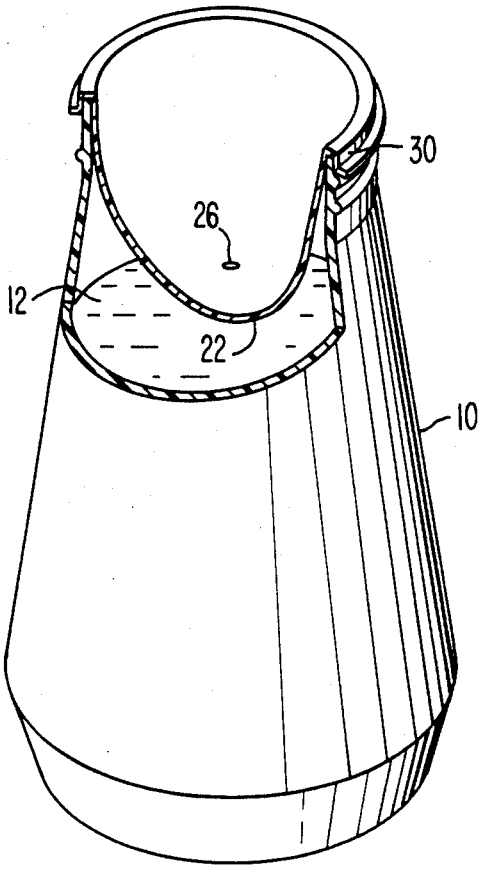
FIG. 3 is a cross-sectional view of a diaphram and neck portion of a bottle in accordance with a second embodiment of the invention.

FIGS. 1, 2 and 2*a* illustrate a first embodiment of the invention. Referring to FIG. 1, the rub-on applicator includes a flexible bottle or container 10 containing a liquid 12 to be rubbed onto a surface. The bottle end has a neck 14 whose top upper edge or lip 16 defines an upper opening or mouth 18. The neck 14 has external screw threads 20 for engaging internal screw threads of a bottle top not shown in the drawings. A thin flexible cupped diaphram 22 has a peripheral flange 24 sealed to the lip 16 so as to close the mouth 18. The diaphram 22 has one or more centrally located very small permanently open holes such as hole 26 formed therein.

The flange 24 is typically heat sealed to the lip 16 as by the application of heat from a heated contact plate. Alternatively, the flange may be radio frequency heat sealed using a foil lined closure to press the flange 18 against the bottle lip 16.

The bottle 10 must be formed of a material which is compatible with the liquid product 12 that it contains. The bottle material must also be flexible enough to be manually squeezed and heat sealable to a selected diaphram material. LDPE, PVC, and PET plastics are examples of materials having suitable properties for the bottle. Bottles formed from these materials are available from suppliers such as W. Braun Company, Chicago, Ill., and Lerman Container Company, New Haven, Conn.

The diaphram 22 must be sufficiently flexible that when the bottle is turned upside down and squeezed, the weight of the liquid mixture in the bottle and/or the pressured generated as the bottle is squeezed, as illustrated in FIG. 2, causes the diaphram 22 to turn inside out, reversing its normal position until it is fully extended out the top of the bottle so that the outer surface 28 of the diaphram 22 has a convexed shape. In this condition as illustrated in FIG. 2, the diaphram is filled with the liquid and, as the bottle is squeezed, a small flow of liquid will be extruded from the diaphram hole 26.

The diaphram 22 should also be of sufficient flexibility that when it is rubbed over a surface to be coated, spreading the extruded liquid into a thin film, the diaphram is still flexible, and the degree of flexibility can be controlled by varying the amount of pressure applied to the bottle and allows the diaphram to be selectively deformed and compressed against the surface to be coated, providing a wide rubbing area for flat surfaces as shown in FIG. 2*a*, or alternately conforming to irregular surfaces.

In the preferred embodiment, the diaphram has a thin uniform thickness. Accordingly, the diaphram may be produced with high-speed vacuum forming techniques at less than half the cost of injection molding. Also, vacuum forming allows a range of material choices for the diaphram which would not be possible using injection molding. For example, the diaphram may be formed of a laminate. During vacuum forming of a diaphram, a small, somewhat thickened, slightly inwardly curved portion 29 may be formed around the hole 26. Due to its increased thickness, this portion 29 is typically resilient and assures that the hole 26 is always open. The size and curvature of the thickened portion 28 is not so great as to substantially effect the overall flexibility and other qualities of the diaphram as discussed above.

The optimum diaphram material must possess excellent flexural properties. Each time the applicator is used, the diaphram is forced to turn inside out, extend under pressure from the bottle, and then turned inside again under vacuum from within the bottle. This action severely folds and crimps the diaphram, and it must not crack or break during the product life. The diaphram material must also resist abrative forces encountered as it is used to rub the liquid product over the surface to be coated. Depending on the surface to which the liquid is to be applied, the abrasive action can be substantial and long-term. For example, in one use of the applicator, where cooking oil is rubbed onto cast iron utensils, the diaphram must slide over 20,000 linear inches of cast iron to apply a six ounce reservoir of oil in an approximate point 0.010 inch coating.

Other application conditions may place additional requirements on the diaphram material. Using the example of cooking oil applied to utensils, in some cases the temperature of the utensil may be 200° to 300° and the diaphram material must function within this temperature range. A number of diaphram materials have been tested for such applications and a silicone material produced by General Electric, Waterford, N.Y., fluoroplastic produced by Dupont, Wilmington, Del., and nylon produced by Allied Chemical Corporation, Morristown, N. J., have been found to provide suitable performance and have suitable temperature properties for most uses. For example, a laminate of nylon (1½ mil) and polyethylene (3½ mil) in a uniform overall the thickness of 5 mils has been found satisfactory for application of cooking oil to hot utensils. (In this example, the polyethylene is provided for purposes of the heat sealing to the lip of the bottle.) The nylon may have a thickness in the range of 1 to 32 mils and still provide satisfactory results. If the diaphram is formed of silicone or fluoroplastic, a suitable range of thickness is also 1 to 32 mils.

Variations in the embodiment of the invention illustrated in FIGS. 1 and 2 can be made in order to create additional benefits for specific liquid products to be applied or particular manufacturing requirements. For example, FIG. 3 illustrates an applicator in which the diaphram, otherwise identical to that illustrated in FIGS. 1 and 2, has a circular, downwardly extending wall 30 at the outer edge of the flange 24. This downwardly extending wall provides important advantages for certain types of high-speed production. In particular, the circular wall 30 is sized to slip snugly over the outside of the bottle mouth, positioning and holding the diaphram 22 centered over the mouth 18 of the bottle 10 during the heat sealing operation.

Without the downwardly extending wall 30, during manufacture the diaphram 22 could shift sideways and touch the inside wall of the bottle neck 14 at one point. Thus, during heat sealing, the spot where the diaphram and inside wall of the neck 14 are touching may seal together, and the diaphram 22 will not be able to fully extend from the bottle for use, or will be forced to extend at an angle to the vertical. Moreover, the embodiment illustrated in FIG. 3 prevents the diaphram flange 24 from wrinkling, or rolling off the bottle lip 16 in such manufacturing operations as call for a closure to be applied to the bottle before an RF sealing operation, where such an operation is used to seal the flange to the bottle lip.

Finally, the downwardly extending wall 30 also aids in manufacturer by acting as a denesting spacer when numbers of diaphrams are stacked together for automatic dispensing. Without this denesting feature to hold them apart, the very thin, flexible diaphrams tend to completely nest and stick together, and it is very difficult to pull only one off of the top of the stack.

Figure 4:
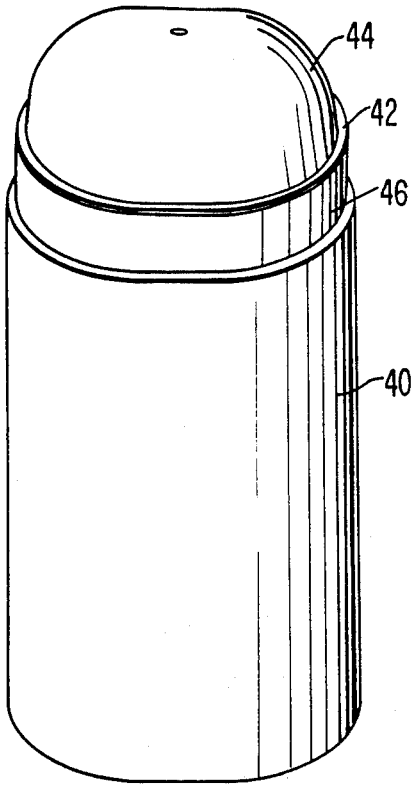
FIG. 4 is a perspective view of a third embodiment of the rub-on applicator in accordance with the present invention.

FIG. 4 illustrates another embodiment of the invention wherein a squeeze bottle 40 has a generally oval cross section and an oval lip 42. The rub-on applicator is also provided with a diaphram 44 sealed at its periphery to the lip 42, the diaphram 44 having a generally oval cross section. Other than the oval cross sections of the bottle 40 and membrane 44, the structure and operation of this embodiment is substantially identical to that illustrated in FIGS. 1 and 2. As is apparent from FIG. 4, the neck 46 of the bottle 40 is adapted to receive a snap-on cap (not illustrated in the drawings).

Figure 5:
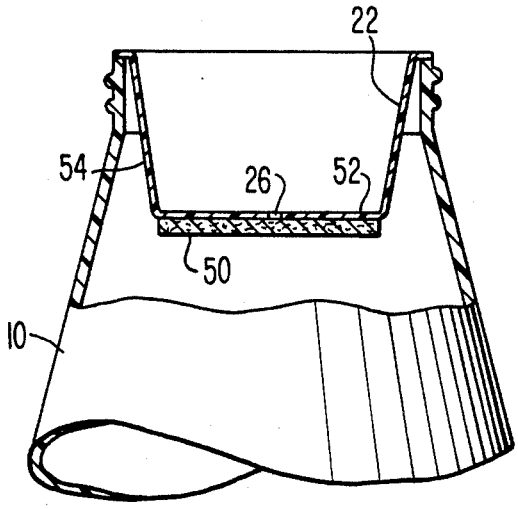
FIG. 5 is a partial cross-sectional view of the diaphram and neck portion of a fourth embodiment of the invention.

FIG. 5 illustrates another embodiment of the rub-on applicator of the invention in which a porous foam or fibrous pad 50 is applied to a central portion 52 of the inside surface 54 of the membrane 22 so as to cover and regulate the flow of liquid through the hole 26. As is illustrated in FIG. 5, the pad 50 tends to rigidify the central portion 52 of the membrane 22 so that it remains substantially flat whether in its normal position illustrated in FIG. 5 or pushed outward of the bottle 10 when the bottle 10 is turned upside down and squeezed to eject liquid therefrom in the manner illustrated in FIG. 2. The pad 50 slows the flow of liquid through the hole 26 and is particularly suited for precise application of very thin liquids which would flow rapidly through the hole 26 were it not for the pad.

Figure 6:
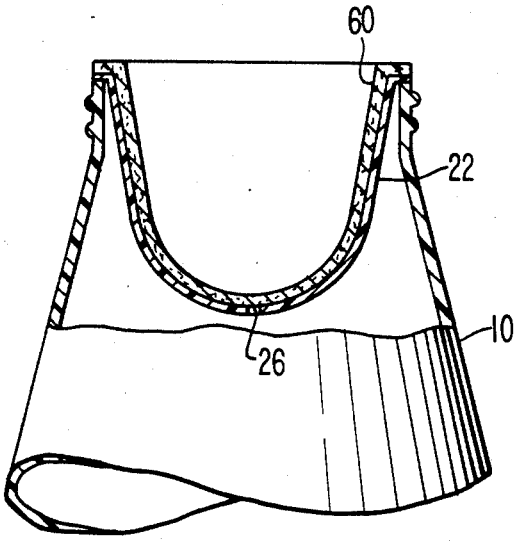
FIG. 6 is a partial cross-sectional view of a fifth embodiment of the present invention.

FIG. 6 illustrates a further embodiment of the invention in which a foam or fibrous layer 60 covers the outside surface 28 of the diaphram 22. This outside layer 60 provides a rough, irregular spreading surface which may be required for the particular liquid to be applied and surface to be coated.

Figure 7:
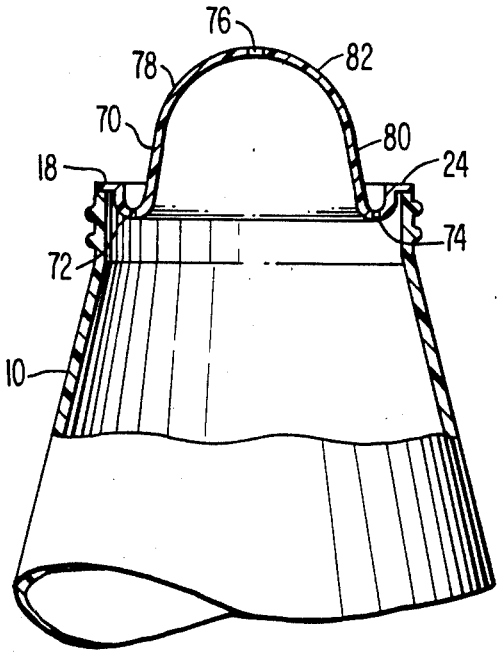
FIG. 7 is a partial cross-sectional view of a sixth embodiment of the rub-on applicator of the invention.

FIG. 7 illustrates an embodiment of the invention in which the diaphram 70 is molded with a circular channel 72 extending into the mouth 18 of the bottle 10 immediately adjacent the flange 24. Also, at least one hole 74 is provided at the bottom of the channel 72 for reasons to be explained below. The diaphram 70 is also provided with at least one central hole 76 which is larger than the hole 26 of the previous embodiments and sufficiently large to permit an adequate flow of air therethrough so that the diaphram is not drawn inward of the neck of the bottle by suction when compression on the bottle 10 is released. Thus, the diaphram 70 takes the position shown in FIG. 7 irrespective of the orientation of the applicator or whether the bottle 10 is being squeezed or not.

The rub-on applicator illustrated in FIG. 7 is used for coating a surface with a liquid stored in the bottle in the same manner as the prior embodiments. However, after use, the diaphram 70 remains in the form shown in FIG. 7, extending outward of the bottle with the outer surface 78 of the central portion thereof having a convex shape. Thus, any liquid remaining on the surface 78 after use of the applicator to apply liquid to a surface, will flow downward into the channel 72 from which it flows through the holes 78 into the bottle. Thus, like the prior embodiments, any liquid on the outer surface of the diaphram will automatically flow back into the bottle.

In order to maintain the channel 72 in the shape shown in FIG. 7 both during use when the bottle 10 is being compressed in an upside down orientation and when the bottle is upright and not under compression, the channel 72 and the side wall portion 80 of the diaphram extending upwardly from the channel 72 are somewhat thicker and therefore more rigid or resilient than the central portion 82 of the diaphram 70. Nevertheless, the central portion 82 of the diaphram 70 should be sufficiently flexible so as to provide a broad flexible surface for rub-on application of the liquid to the surface to be coated, substantially as in the previously described embodiments.

Figure 8:
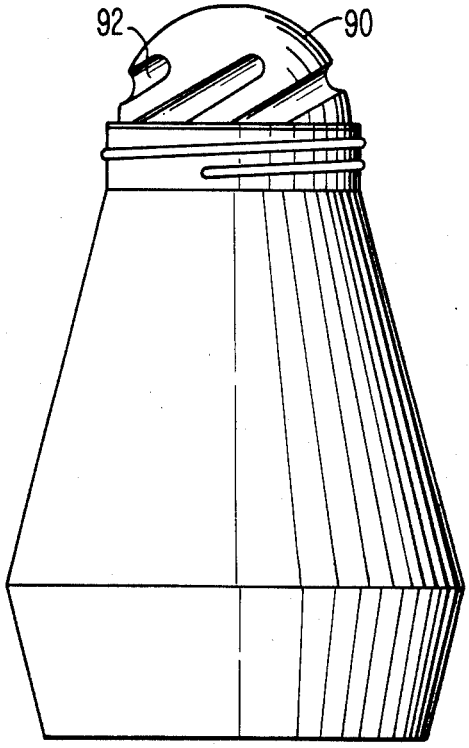
FIG. 8 is an elevational view of a seventh embodiment of the rub-on applicator in accordance with the present invention.

Referring to FIG. 8, there is illustrated another embodiment of the invention which, again, is similar to the embodiment illustrated in FIGS. 1 and 2, but for the particular construction of the diaphram. This embodiment is provide with a diaphram 90 having flutes 92 therein. The flutes 92 increase the flexibility of the diaphram and therefore permits a less inherently flexible material such as heavier gauges of nylon to be used for the diaphram. Thus, when the diaphram 90 is caused to move from the inward position illustrated in FIG. 8 to an outward position when the bottle is compressed as in FIG. 2, the diaphram 90 will be folded and creased along the flutes 92 in order to facilitate the change in condition.

While particular embodiments of the present invention have been illustrated and described, it will be apparent to those skilled in the art that various changes and modifications can be made without departing from spirit and scope of the invention. The appended claims are intended to cover all such modifications within the scope of the invention. For example, more elastic embodiments of the diaphram such as an elastic silicone film may be used.

What is claimed is:

1. A rub-on applicator for rubbing a liquid onto a surface to be coated, comprising a compressible container having a mouth at an upper end thereof, for containing a liquid to be rubbed on a surface, a thin flexible cupped diaphragm having a periphery, said diaphragm being sealed at said periphery to said mouth of said container, said diaphragm having an outer surface facing outward of said container cupped entirely concavely and inwardly of said container, said diaphragm having at least one permanently open hole therein so that a majority of the liquid accumulated on said outer surface when said outer surface is cupped concavely inwardly flows through said at least one hole into said container, said diaphragm being sufficiently flexible as to be moveable in an outward direction so as to project outwardly of said container such that said outer surface is substantially entirely convex, in response to compression of said container.

2. A rub-on applicator as in claim 1, wherein said diaphragm has flutes formed therein to facilitate movement of said diaphragm between a position in which said outer surface is cupped entirely concavely and inwardly of said container and a position in which said outer surface is substantially entirely convex and projects outwardly of said container.

3. A rub-on applicator as in claim 1, wherein said diaphragm is sufficiently flexible that said outer surface conforms to the surface to be coated when said outer surface is rubbed thereon while said container is being compressed.

4. A rub-on applicator as in claim 1, wherein said mouth and said diaphragm are generally oval in cross sections taken in planes perpendicular to said outward direction.

5. A rub-on applicator as in claim 1, wherein said diaphragm has a substantially uniform thickness.

6. A rub-on applicator as in claim 5, wherein said diaphra is sufficiently flexible as to be folded and crimped while moving from a condition in which said outer surface is concave inward to a condition in which said outer surface is convex, when said container is compressed.

7. A rub-on applicator as in claim 5, wherein said diaphragm is formed of one of nylon, fluoroplastic or silicone.

8. A rub-on applicator as in claim 5, wherein said diaphragm is formed of a laminate of nylon and polyethylene having an overall thickness of about 5 mils.

9. A rub-on applicator as in claim 1, wherein said diaphragm has a uniform thickness except for an area immediately surrounding said at least one hole, said diaphragm having a thickened portion in said area less flexible than the remainder of said diaphragm.

10. A rub-on applicator as in claim 9, wherein said thickened portion is molded concave inward with respect to said mouth.

11. A rub-on applicator as in claim 1, wherein said container is formed of plastic.

12. A rub-on applicator as in claim 1, wherein said diaphragm is sufficiently flexible as to be folded and crimped while moving from a condition in which said outer surface is concave inward to a condition in which said outer surface is convex, when said container is compressed.

13. A rub-on applicator as in claim 1, wherein said diaphragm is formed of one of fluoroplastic, nylon or silicone.

14. A rub-on applicator as in claim 1, wherein said diaphragm includes a flange heat sealed to a top surface of said lip and a downwardly projecting wall projecting downwardly from an outer edge of said flange and fitting snugly over an outside surface of said lip.

15. A rub-on applicator as in claim 1, further comprising a porous pad fixed over said at least one hole on an inner surface of said diaphragm opposite said outer surface.

16. A rub-on applicator as in claim 1, further comprising a porous foam layer on said outer surface.

17. A rub-on applicator as in claim 1, further comprising a porous fibrous layer on said outer surface.

18. A rub-on applicator as in claim 1, further comprising a liquid to be applied filling said container, wherein said at least one hole is sufficiently small that said diaphragm is drawn inward of said container by differential air pressure when said container is released from compression applied thereto.

19. A rub-on applicator for rubbing a liquid onto a surface to be coated, comprising:

a compressible container having a lip surrounding a mouth at an upper end thereof, for containing a liquid to be rubbed on a surface; and a thin flexible cupped diaphragm sealed at its periphery to said lip of said container;

said diaphragm having an outer surface facing outward of said container normally cupped entirely concavely and outwardly of said container, at least one permanently open central hole therein, and sufficient flexibility as to project outwardly of said container such that a central portion of said outer surface surrounding said at least one central hole, constituting most of said outer surface, is substantially entirely convex, in response to compression of said container;

said at least one central hole being sufficiently large that a flow of the liquid in said container is forced out thereof through said at least one central hole in response to compression of said container and that a sufficient flow of air passes therethrough in response to release of said compression on said container that said diaphragm remains outward of said container;

a narrow portion of said outer surface surrounding said central portion adjacent said periphery forming an outwardly opening channel having at least one peripheral hole therein opening into said container, whereby a majority of liquid on said outer surface when said outer surface is facing upward flows into said channel and through said at least one peripheral hole into said container.

20. A rub-on applicator as in claim 19, wherein said diaphragm is sufficiently flexible that said outer surface conforms to the surface to be coated when said outer surface is rubbed thereon while said container is being compressed.

* * * * *